US009453484B2

(12) United States Patent
Lecluse et al.

(10) Patent No.: US 9,453,484 B2
(45) Date of Patent: Sep. 27, 2016

(54) FUEL INJECTOR

(75) Inventors: Eric Lecluse, Pezou (FR); Richard Denis Jacques Alain Enters, Vineuil (FR); Bruno Bimbenet, Saint Claude de Diray (FR)

(73) Assignee: Delphi International Operations Luxembourg S.A.R.L. (LU)

( * ) Notice: Subject to any disclaimer, the term of this patent is extended or adjusted under 35 U.S.C. 154(b) by 1374 days.

(21) Appl. No.: 13/265,620

(22) PCT Filed: Apr. 22, 2010

(86) PCT No.: PCT/EP2010/055390

§ 371 (c)(1),
(2), (4) Date: Feb. 7, 2012

(87) PCT Pub. No.: WO2010/122125

PCT Pub. Date: Oct. 28, 2010

(65) Prior Publication Data

US 2012/0125292 A1 May 24, 2012

(30) Foreign Application Priority Data

Apr. 22, 2009 (EP) ..... 09158532

(51) Int. Cl.

| | |
|---|---|
| ***F02M 55/00*** | (2006.01) |
| ***F02M 61/14*** | (2006.01) |
| ***F02M 61/16*** | (2006.01) |

(52) U.S. Cl.

CPC ..... *F02M 55/005* (2013.01); *F02M 61/14* (2013.01); *F02M 61/168* (2013.01); *F02M 2200/40* (2013.01); *Y10T 29/49826* (2015.01)

(58) Field of Classification Search

CPC .. F02M 69/465; F02M 55/02; F02M 55/005; F02M 35/10216; F02M 55/025; F02M 37/0017; F02M 37/0023; F02M 37/0047; F02M 37/0052; F02M 51/00; F02M 51/005; F02M 55/002; F02M 69/042; F02M 2200/85; F02M 2200/851; F02M 2200/852; F02M 2200/853; F02M 2200/855; F02M 2200/856; F02M 2200/857; F02M 2200/858

USPC ..... 123/468, 469, 470, 471

See application file for complete search history.

(56) References Cited

U.S. PATENT DOCUMENTS 6,314,936 B1 * 11/2001 Angstrom ..... F02M 61/14 123/305
6,420,817 B1 * 7/2002 Ricci-Ottati ..... F02D 41/2096 123/498

(Continued)

FOREIGN PATENT DOCUMENTS

DE 10 2007 002758 10/2007
DE 10 2006 022803 11/2007

(Continued)

OTHER PUBLICATIONS

English Translation of Japan Office Action dated Jan. 29, 2013.

*Primary Examiner* — Hai Huynh
*Assistant Examiner* — Raza Najmuddin
(74) *Attorney, Agent, or Firm* — Joshua M. Haines

(57) ABSTRACT

A fuel injector for an internal combustion engine includes: an injector body of substantially elongate form and defining an injector body axis; an injector nozzle disposed at one end of the injector body; and a plurality of element connectors for providing fluid and/or electrical connection into and/or out of the fuel injector wherein at least some of the element connectors are arranged to be rotatable relative to one another about the injector body axis.

20 Claims, 9 Drawing Sheets

(56) References Cited

U.S. PATENT DOCUMENTS

| | | | |
|---|---|---|---|
| 2006/0000451 | A1 | 1/2006 | Ricco et al. |
| 2006/0076437 | A1 | 4/2006 | Dallmeyer |
| 2008/0257990 | A1 | 10/2008 | Matteucci et al. |
| 2009/0108093 | A1 | 4/2009 | Mattes et al. |

FOREIGN PATENT DOCUMENTS

| | | | | |
|---|---|---|---|---|
| EP | 1 561 942 | | | 8/2005 |
| EP | 1 612 405 | | | 1/2006 |
| GB | 2 435 303 | | | 8/2007 |
| JP | 05-157018 | | | 6/1993 |
| JP | H7-72512 | B2 | | 8/1995 |
| JP | 2833103 | B2 | | 10/1998 |
| JP | H10-325374 | A | | 12/1998 |
| JP | 2004-538422 | | | 12/2004 |
| JP | 4370738 | B2 | | 9/2009 |
| WO | 98/36170 | | | 8/1998 |
| WO | 03/016707 | | | 2/2003 |
| WO | WO 03016707 | | * | 2/2003 |
| WO | 2006/015221 | | | 2/2006 |

* cited by examiner

FUEL INJECTOR

TECHNICAL FIELD OF THE INVENTION

The present invention relates to the field of fuel injectors. In particular, the present invention relates to an improved fuel injector where the injector needle is controlled by an external command, e.g. a solenoid.

BACKGROUND TO THE INVENTION

A known fuel injector is shown in FIG. 1 and the operation of such an injector is described in FIGS. 2*a* to 2*e*.

Turning to FIG. 1, a solenoid controlled fuel injector 1 is shown. The injector 1, which is generally elongate in form and which defines a longitudinal axis that runs the length of the injector, comprises an injector body 3 (also sometimes referred to as a nozzle holder body) and an injector nozzle 5 comprising a plurality of nozzle holes (not shown) that are arranged in use to inject fuel into a combustion chamber (not shown).

Within the injector body 3 is provided a fuel supply passage 7 which receives fuel under high pressure from a high pressure fuel pump 9. The pump is supplied by a fuel reservoir 11.

Also located within the injector body 3 is a solenoid, of which the bobbin 13 (windings of the solenoid) is shown in FIG. 1. Electrical connections 15 pass through the length of the injector body 3 to the solenoid.

A backleak return path 17 is also provided within the injector body 3 through which fuel at low pressure may pass, in use, as described below in relation to FIGS. 2*a* to 2*e*.

It is noted that the main longitudinal axis 19 of the injector nozzle 5 (and injector body 3) is offset from the longitudinal axis 21 of the solenoid in this fuel injector 1, the offset being referred to as the "Lift" in FIG. 1. The internal flow paths and mechanism of the fuel injector, the "hydraulic command" components, are described in more detail in FIG. 2 and are generally referred to as feature 23 in FIG. 1.

It is noted that the injector nozzle 5 is held on the end of the injector body by virtue of a compressive load applied by a capnut 25.

FIGS. 2*a* to 2*e* show the working principle of the injector 1 of FIG. 1. In FIG. 2 the internal mechanism of feature 23 is shown. It can be seen that the fuel supply passage 7 extends down through the injector 1 to the injection nozzle 5. Paths on an injection needle 27 and chambers within the injector body 3 allow high pressure fuel to flow down a bore 29 in the injection nozzle bore to the tip of the needle 27.

In the position shown in FIG. 2*a* the needle 27 is seated against the nozzle 5 and no fuel is able to pass through the nozzle hole 31. It is noted that high pressure fuel within the nozzle bore 29 acts on surfaces of the injector needle 27 to exert an upward force.

High pressure fuel also flows through a valve 33 into a spring chamber 35 above the needle 27. The fuel in this chamber therefore exerts a downwards force on the needle. Also within the chamber is a spring 37 which acts to urge the needle in a downward direction towards the seated position.

A control valve 39 is located above the spring chamber 35 and below the solenoid 41. In FIG. 2*a* this valve is closed. Low pressure fuel is located in the backleak return path 17.

In FIG. 2*b* the solenoid controlled valve 39 has been opened. It is noted that the pressure within the spring chamber 35 has now dropped. The force exerted by the fuel within the chamber and the spring itself is still sufficient however to hold the needle in place in its seated position.

The pressure within the spring chamber 35 drops further as fuel spills down the backleak path 17 to the low pressure reservoir until in FIG. 2*c* the injector needle lifts from its seat to allow fuel to be injected through the nozzle hole(s) 31.

In FIG. 2*d* the control valve 39 has been closed again and the pressure within the spring chamber 35 increases. As the pressure increases, the needle begins to close until, in FIG. 2*e*, the needle returns to its seated position and fuel injection ceases.

In the arrangement of FIGS. 1 and 2 it is noted that the size of the fuel supply pathway 7 is limited by the external dimensions of the injector nozzle 5, the nozzle holder body and the size of the actuator 41 (e.g. solenoid). In a diesel engine environment, and for this typical architecture, the volume of the high pressure fuel pathway is in the region of 1-1.5 cc.

It is noted that increasing the volume of the high pressure fuel line would aid in optimizing the operation of the injector. It is therefore an object of the present invention to provide a fuel injector having a high pressure fuel line with a greater volume than known fuel injectors.

In the example of FIG. 1, it is noted that the high pressure inlet (connected to the pump 9) and the electrical connections 15 are arranged on the same side of the injector body. Depending on the configuration of the engine system into which the fuel injector is incorporated it would be desirable to be able to alter the positioning of these "connection" points. It is therefore also an object of the present invention to provide a fuel injector which can be reconfigured depending on the engine system into which it is incorporated.

SUMMARY OF THE INVENTION

According to a first aspect of the present invention there is provided a fuel injector for an internal combustion engine, the fuel injector comprising: an injector body of substantially elongate form and defining an injector body axis; an injector nozzle disposed at one end of the injector body; and a plurality of element connector means for providing fluid and/or electrical connection into and/or out of the fuel injector wherein at least some of the element connector means are arranged to be rotatable relative to one another about the injector body axis.

As noted above, known fuel injector arrangements are limited since the orientation of the various components is fixed. However, in the present invention the fuel injector comprises a plurality of element connector means (e.g. a high pressure inlet, low pressure outlet, electrical connection point), at least some of which are arranged to be rotatable relative to one another about the injector body axis. In this manner the connection points into the fuel injector (e.g. fuel inlets and outlets and electrical connection points) can be moved relative to one another thereby allowing the injector to be re-configured.

Conveniently, the element connector means may comprise a high pressure inlet (to supply high pressure fuel to a high pressure fuel supply passage and a low pressure outlet (to allow fuel returning from a backleak return fuel path to be removed from the injector), the inlet and outlet being rotatable relative to one another.

Conveniently, the plurality of element connector means may comprise at least one fuel related element connector means (e.g. a fuel inlet or a fuel outlet) that is rotatable about the injector body axis.

Conveniently, all of the element connector means may be rotatable about the injector body axis.

The fuel injector may further comprise a plurality of elements (e.g. internal electrical and hydraulic components and features such as electrical connections, fuel supply passages and fuel backleak returns) located at least in part within the injector body, each of the plurality of elements being in communication with an element connector means (e.g. a high pressure inlet, low pressure outlet, electrical connection point).

Elements (or "injector elements") may be located either entirely within the injector body or alternatively may be located in part within the injector body. For example, a backleak return fuel path may run from the injector nozzle through the inside of the injector body to a component such as an end cap which is located at the end of the injector body opposite to the injector nozzle. In this example, a low pressure fuel outlet may be formed in the surface of the end cap arrangement such that the outlet is in communication with the injector nozzle via the backleak return path which runs partially through the end cap arrangement and partially within the injector body. The injector element in this example may therefore be regarded as located at least in part within the injector body. In an alternative example a fuel supply passage may be located entirely within the injector body such that at one end it is in communication with the injector nozzle and at the other end it is in communication with a high pressure inlet which is a separate component to the injector body.

It is noted that more than one element may be in communication with the same element connector means. For example, an actuator arrangement would be in communication with an electrical connection point via electrical connections within the fuel injector.

Conveniently in order to allow the element connector means to be rotated relative to one another the elements may be distributed axially about the injector body axis. Conveniently, one of the elements may be distributed along the injector body axis.

Preferably, one of the elements is a fuel supply passage which may conveniently be annularly arranged about the injector body axis. In this example, the present invention therefore provides a fuel injector in which the fuel supply passage arrangement is axially distributed around the main axis (the longitudinal axis) of the injector body. The fuel supply passage arrangement may comprise an annular space around the axis or alternatively may comprise a plurality of fuel pathways arranged about the main axis. It is noted that the term "fuel supply passage arrangement" is regarded as equivalent in the following description to the terms "fuel supply line", "fuel supply pathway" or "fuel supply passage".

An axial configuration for the fuel injector enables a larger volume of fuel supply pathway to be provided within a given fuel injector. Conveniently, any elements within the injector, e.g. control actuator for the injector nozzle, fuel backleak pathways, electrical connections etc., may be located such that they are enclosed by the high pressure fuel pathway.

It has been found that the axial fuel injector configuration according to embodiments of the present invention significantly increases the volume of the high pressure fuel supply line. For example, taking the known fuel injector as described with reference to FIG. 1 an increase in the volume of the high pressure fuel supply line up to around 3 cc has been achieved.

Such an increase in volume of the high pressure fuel supply line has a number of advantages. For example, the increase in volume within the injector can improve the injection rate that is achievable from the injector. The capability of the injector to handle multiple injections may also be improved.

In a common rail system, the ability to increase the volume of the high pressure supply line may also enable the volume of the common rail to be reduced. In some cases, it may even be possible to remove the rail entirely since the high pressure volume can effectively be located within the fuel injector itself. This may offer significant benefits in the ability to design and arrange an engine system.

A further advantage of an increased volume fuel supply line in accordance with embodiments of the present invention is the ability to install features within the injector to reduce the effect of pressure waves within the fuel pathways.

Further preferred features and advantages to the present invention are described below.

The fuel injector may conveniently further comprise a needle member which is engageable with a needle seating to control fuel delivery from the injector nozzle and an actuator arrangement to control movement of the needle member, wherein the actuator arrangement and injector body define a common axis. Conveniently, in such a configuration the fuel supply passage arrangement may surround the actuator arrangement.

Conveniently, the fuel supply passage arrangement may be arranged to extend parallel to the main axis of the injector body.

Preferably, the fuel supply passage arrangement may be arranged to completely encircle the injector axis. The cross section of the fuel supply passage arrangement may take any convenient configuration but conveniently, it forms an annular sheath within the body of the injector (i.e. an annular space is defined within the injector body for the supply of fuel in use to the injector nozzle).

Where the fuel supply passage arrangement defines such an annular space within the injector body then preferably the fuel supply passage arrangement may be located within the injector body in such a manner that its axis is common with that of the injector body.

It is noted that the axial arrangement of the fuel passage allows components to be mounted on a common axis with the injector body. Depending on the arrangement of components within the injector body this may provide the advantage that forces acting on the injector body are reduced compared to prior art arrangements.

Conveniently, the elements may be arranged such that one element is arranged along the injector body axis with the remaining elements being annularly arranged about the injector body axis such that they are concentrically mounted with respect to one another.

It is further noted that mounting elements of the injector along or about the injector axis has the benefit that the orientation of inlet and outlet orifices to these elements may be orientated at any convenient angle about the main injector axis. In prior art injectors, the asymmetric nature of the injector elements may lead to restrictions on the placement of the associated inlet or outlets. In embodiments of the present invention by contrast, the elements may be loaded down the injector from an opening in the top and may essentially be concentrically mounted so that the associated inlet or outlets can be rotated to any desired orientation. This has benefits in engine design as there is flexibility in the arrangement of the injector. It may also benefit the angular location of the injector nozzle holes by reducing the tolerance stack up.

The internal elements of the fuel injector may also further comprise a backleak return fuel path arranged in use to return fuel from the hydraulic command/injector nozzle to a fuel reservoir; an electrically controlled actuator arrangement for controlling fuel supply through the injector nozzle; and electrical connections arranged to connect the actuator arrangement to a control unit wherein the backleak return path, actuator arrangement and electrical connections may be arranged either parallel to or along the injector body axis.

Conveniently, the fuel supply passage may be associated with a high pressure fuel inlet, the backleak return path may be associated with a low pressure fuel outlet and the electrical connections may be associated with an electrical connection point. The fuel supply passage arrangement may in such an injector be arranged to surround the backleak return path, actuator arrangement and electrical connections. The elements may be mounted concentrically relative to one another.

It is noted that the high pressure inlet may conveniently be integrally formed with the injector body. Such an arrangement has the advantage of simplifying the sealing function at the high pressure inlet.

Conveniently, the injector body may define a bore, the bore having an open first end and a partially closed second end, the second end comprising an opening through which the injector nozzle projects.

Conveniently, one of the plurality of elements may be a fuel supply passage and a first surface of the fuel supply passage may be defined by the injector body and a second surface of the fuel supply passage may be defined by a high pressure sleeve, the sleeve being arranged such that, in use, sleeve generated loadings seal the fuel supply passage at the partially closed end. Conveniently, at least one of the plurality of elements may abut and be held in place by the partially closed end of injector body. The plurality of elements may also be arranged to be urged towards the partially closed end by sleeve generated loadings.

In such a fuel injector configuration a first end of the injector body may have an opening through which the injector nozzle projects and the injector body may define a bore within which the high pressure sleeve is located, an annular gap between the sleeve and injector body defining the fuel supply passage arrangement. It is further noted that in such a configuration the high pressure sleeve may be arranged to apply a load on the injector body and injector nozzle in order to seal the fuel injector.

The fuel injector may further comprise a capnut arranged to secure the injector nozzle to the injector body. Alternatively, as noted above, the presence of the axially distributed supply passage of the present invention may be realized by the presence of a high pressure sleeve of material within the injector body. This sleeve may be arranged such that it can apply a compressive loading between the injector body and the injector nozzle thereby allowing a variant of the injector to be designed that does not require a capnut to hold the various elements together.

The fuel injector may also comprise an end cap arrangement located at the end of the injector body opposite to the injector nozzle. The end cap arrangement may further comprise features that extend from the injector body (e.g. an electrical connection to an actuator arrangement may pass through the injector body into the end cap arrangement). Some of the element connector means may be located on or in the end cap arrangement (e.g. in the above example the electrical connections may be in communication with an electrical connection point mounted on the end cap arrangement).

According to a second aspect of the present invention there is provided a method of assembling a fuel injector comprising providing an injector body defining a bore, the injector body having an open end and a partially closed end, the partially closed end comprising an opening dimensioned to receive an injection nozzle, the method comprising: inserting an injection nozzle into the open end of the bore and through the opening in the partially closed end of the injector body; inserting a plurality of elements of the fuel injector into the bore via the open end; fixing an end cap arrangement to the open end of the injector body.

The present invention comprises a fuel injector configuration which advantageously allows elements to be loaded down the injector from an opening in the top. A partially closed end of the injector bore is arranged to retain the elements in place thereby removing the need for a capnut.

Preferably, the injector body may define an injector body axis and the internal elements may be annularly arranged about the injector body axis. This allows the elements to be concentrically mounted so that their associated inlet or outlets may be rotated to any desired orientation. This has benefits in engine design as there is flexibility in the arrangement of the injector.

Conveniently the fuel injector may comprise a plurality of element connector means for providing fluid and/or electrical connection into/out of the fuel injector.

Preferably the method further comprises rotating at least one element connector means about the injector body axis until a desired orientation of the element connector means is achieved.

According to a third aspect therefore the present invention provides for a fuel injector for an internal combustion engine, the fuel injector comprising: an injector body of substantially elongate form and defining an injector body axis; an injector nozzle disposed at one end of the injector body and a fuel supply passage arrangement defined in the injector body and in fluid communication with the injector nozzle, the fuel supply passage arrangement arranged in use to contain fuel under high pressure; and wherein the fuel supply passage arrangement is axially distributed around the injector body axis.

According to a fourth aspect of the present invention there is provided a fuel injector for an internal combustion engine, the fuel injector comprising: an injector body of substantially elongate form and defining an injector body axis; an injector nozzle disposed at one end of the injector body; and a plurality of elements located, at least in part, within the injector body, wherein the plurality of elements are arranged axially about the injector body axis.

Conveniently, the plurality of elements may be arranged concentrically. The fuel injector may also further comprise a plurality of element connector means for providing fluid and/or electrical connection into and/or out of the fuel injector wherein at least some of the element connector means are arranged to be rotatable relative to one another about the injector body axis.

The plurality of elements may comprise a high pressure supply passage, a backleak return fuel path, an electrically controlled actuator arrangement for controlling fuel supply through the injector nozzle; and electrical connections arranged to connect the actuator arrangement to a control unit.

It is noted that preferred features of the first aspect of the present invention may apply to the second, third and fourth aspects of the present invention.

BRIEF DESCRIPTION OF DRAWINGS

In order that the invention may be more readily understood, reference will now be made, by way of example, to the accompanying drawings in which.

DETAILED DESCRIPTION OF PREFERRED EMBODIMENTS OF THE PRESENT INVENTION

In the following description it is noted that references to "fuel supply passage" or "fuel pathway" are equivalent to the terms "fuel supply passage arrangement" or "fuel supply line".

FIGS. 3 to 12 show fuel injectors in accordance with embodiments of the present invention. It is noted that like numerals denote like features within the drawings.

Figure 3:
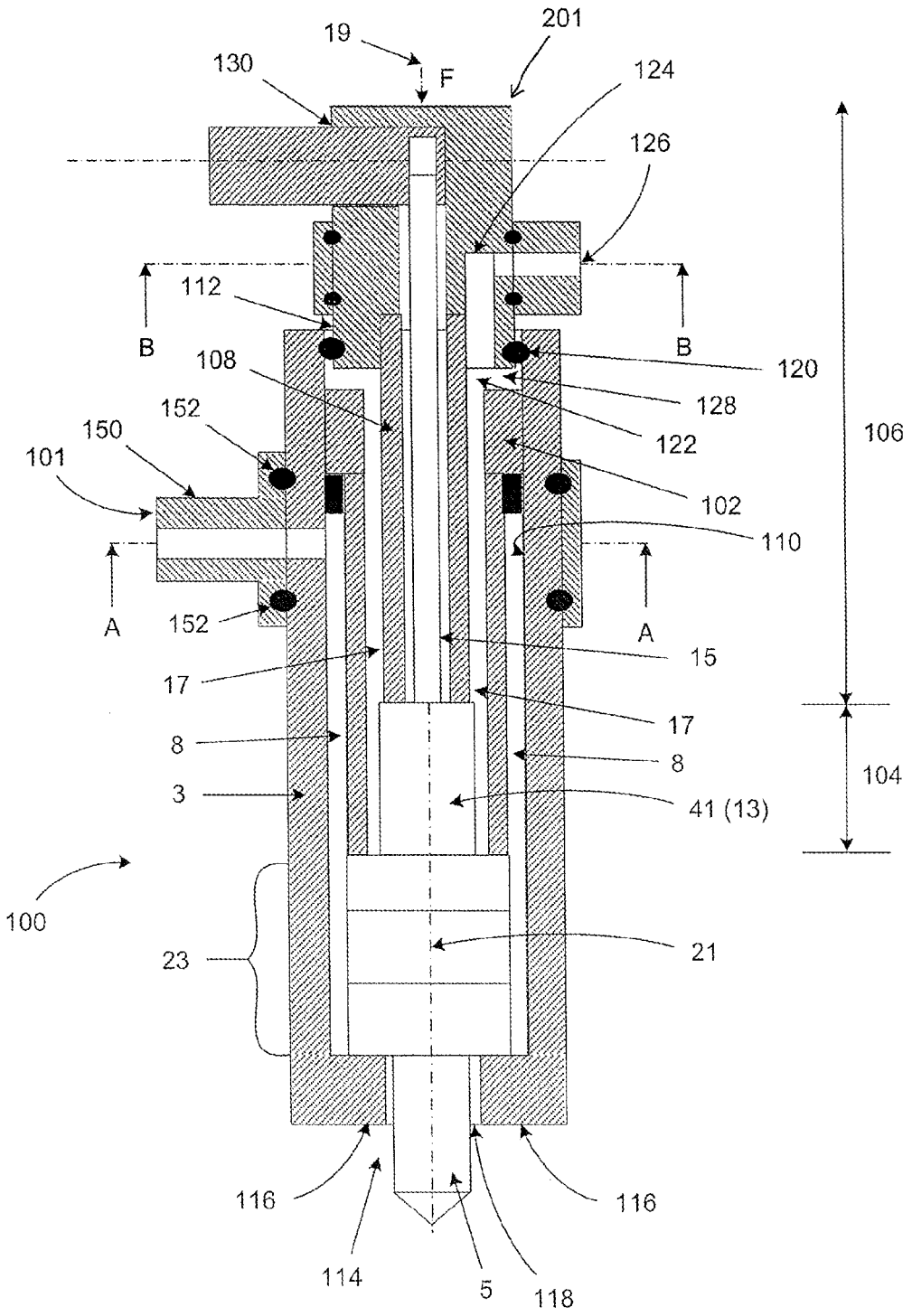
FIG. 3 shows a fuel injector in accordance with an embodiment of the present invention.
Figure 4:
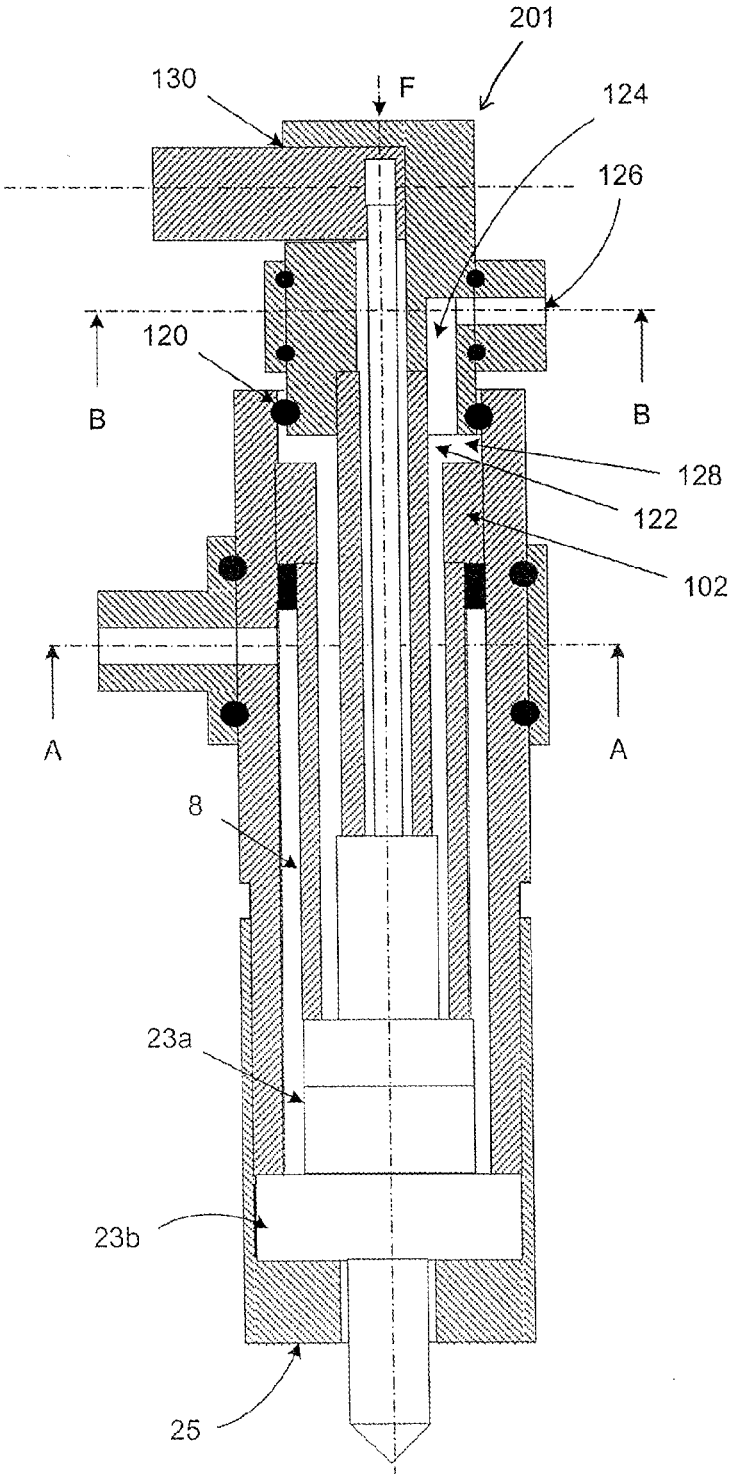
FIG. 4 shows a fuel injector in accordance with a further embodiment of the present invention.

As can be seen from FIGS. 3 and 4 the fuel injector 100 in accordance with the present invention has an axial design. The fuel supply passage 8 now comprises a substantially annular configuration along the longitudinal axis 19 of the injector 1/injector body 3 such that the high pressure fuel supply passage 8 surrounds the solenoid 41, hydraulic control components 23 and the backleak return 17. It is noted that the longitudinal axis 21 of the solenoid is now coincident with the axis 19 of the injector. The pathway 8 is supplied by the high pressure pump 9 (not shown in FIG. 3) as before via a high pressure inlet 101.

Considering the arrangement of FIG. 3 in more detail now, it is noted that the injector body 3 now comprises an annular high pressure fuel supply passage 8 which surrounds and is separated from the backleak return 17 by a high pressure sleeve 102 of high strength steel.

In the arrangement of FIG. 3 the backleak return pathway 17 also has an annular configuration and, at the region 104 of the injector body 3, this surrounds the solenoid 41 which is located coincident with the injector body axis 19. As depicted in FIG. 3 the electrical connections 15 to the solenoid are now located in the region 106 of the injector body 3 along the axis 19 of the injector body. It is noted that the backleak return pathway 17 also surrounds the electrical connections 15 in this upper region 106, the return pathway 17 and electrical connections 15 being separated by a low pressure sleeve 108 which may be constructed from steel or other suitable materials (for example, a suitable plastics material).

Figure 1:
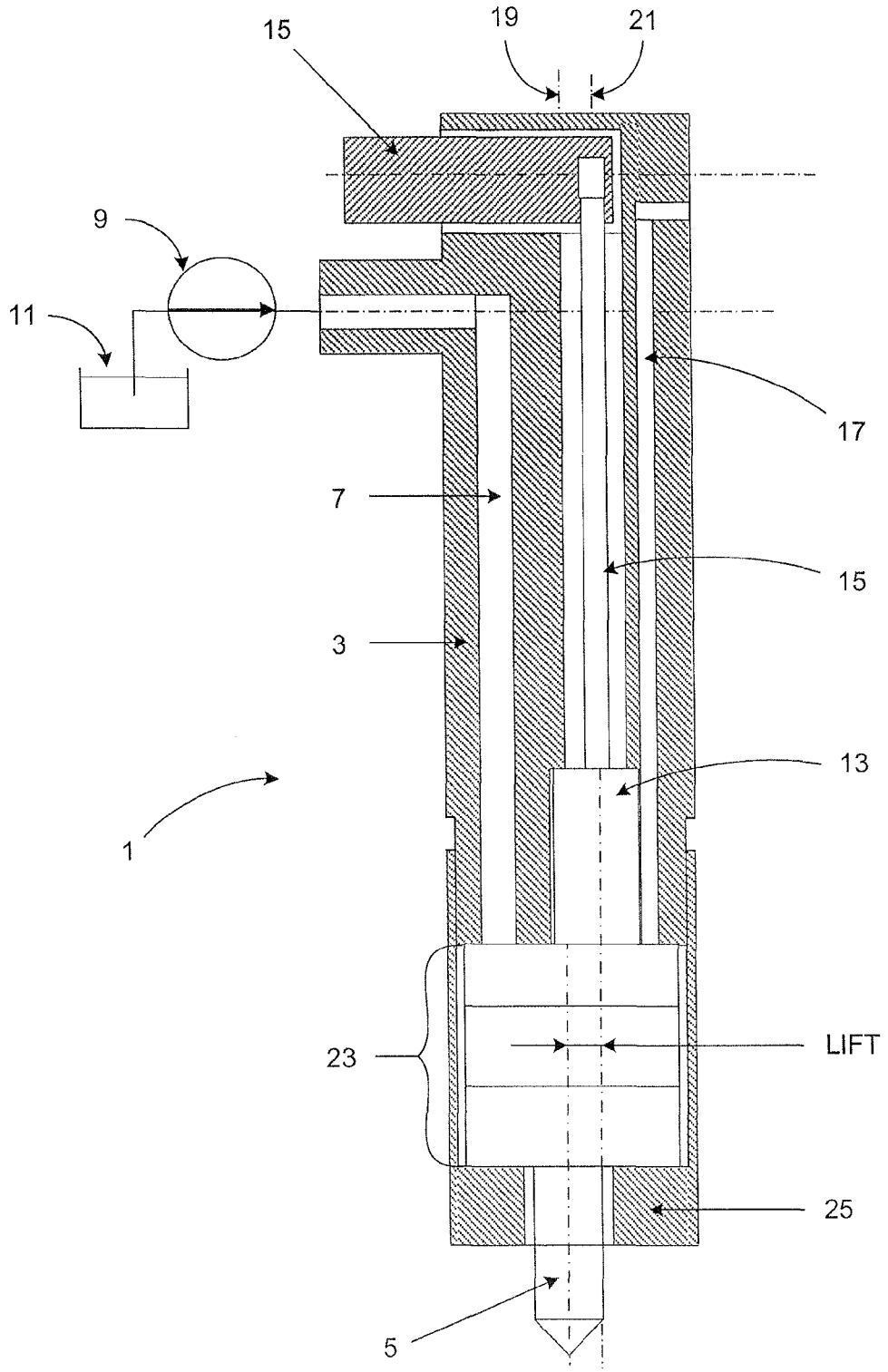
FIGURE 1 PRIOR ART
FIG. 1 shows a known fuel injector.
Figures 2A, 2B, 2C, 2D, 2E:
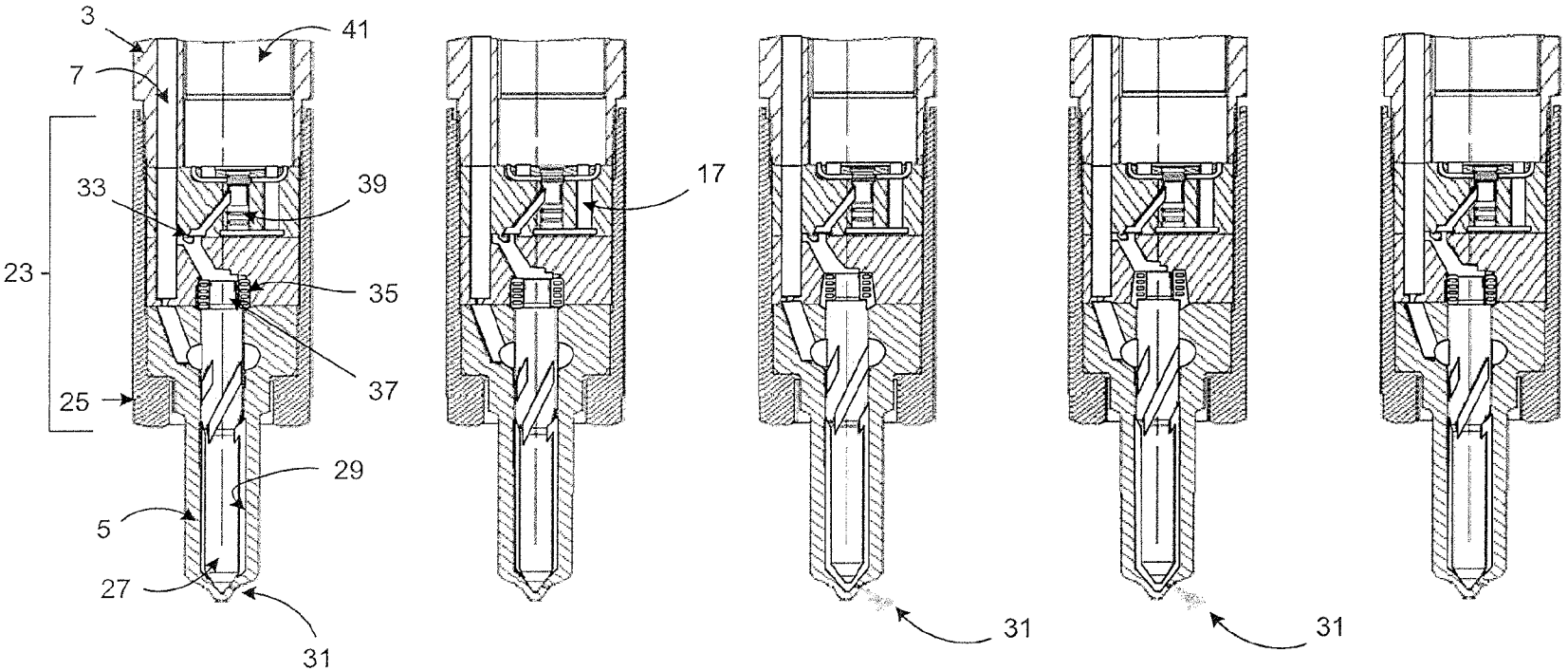
FIGURE 2a PRIOR ART
FIGURE 2b PRIOR ART
FIGURE 2c PRIOR ART
FIGURE 2d PRIOR ART
FIGURE 2e PRIOR ART
FIGS. 2*a* to 2*e* illustrate the working principle of a known fuel injector.

In contrast to the arrangement of FIG. 1, the fuel injector of FIG. 3 does not comprise a capnut. In the arrangement of FIG. 3, the injector body 3 is formed with a bore 110 having one open end 112 and one end 114 which is partially closed by an element 116 which comprises an opening 118 (It is noted that in the embodiment of FIG. 3, feature 116 is integral with the injector body 3). The opening 118 is larger than the injector nozzle 5 but smaller than the diameter of the hydraulic command unit 23. It is also noted that element 116 provides surfaces to receive the internal components which are inserted into the bore 110 of the injector body from the top.

In the arrangement of FIG. 3, contact pressures at the interfaces between various components of the fuel injector are generated by virtue of the load applied from the top of the injector body by the high pressure sleeve 102. It is noted that the high pressure sleeve-generated loadings provide a sealing function to prevent high pressure fuel from leaking from the partially closed end 114 of the injector body. It is also noted that with appropriate design of the internal components of the injector, the contact pressure at the sealing surface may be linked to the internal pressure within the fuel injector. It is also noted that the high pressure sleeve 102 applies load onto the hydraulic command component 23 thereby achieving a seal between the high pressure fuel passage 8 and the backleak return 17.

Low pressure sealing is provided at end 112 of the injector body 3 by means of an O-ring type seal 120 between the injector body 3 and an end cap arrangement 201.

FIG. 4 shows a variation of an injector in accordance with an embodiment of the present invention in which a capnut sealing arrangement is used. It can be seen in this variation that the high pressure fuel pathway 8 terminates on a surface of the hydraulic command unit 23 as opposed to the arrangement 116 of FIG. 3. It is further noted that the hydraulic command unit 23 of FIG. 4 is a two part arrangement comprising a top portion 23*a* and a bottom portion 23*b*, the bottom portion of the unit having a larger diameter than the top portion.

In the FIG. 4 variation of the injector, a first load is applied from the bottom of the injector to the top of the injector by the action of the capnut 25. This first load generates a contact pressure between the injector body 3 and the injector nozzle 5 to prevent leakage. A second load is applied from the top of the injector by the high pressure sleeve 102 acting on the hydraulic command unit 23 and it is noted that this second load reduces the global load between the injector body 3 and the injection nozzle 5 thereby making sealing of the injector 100 more difficult compared to the FIG. 3 arrangement (the second load is however necessary to prevent leakages between the high pressure passage and the backleak region 17).

In both FIG. 3 and FIG. 4 the backleak return pathway 17 branches at point 122 into two separate portions. Pathway 124, which is located within the end cap arrangement 201, is in communication with backleak outlet orifice 126 and pathway 128 terminates at sealing ring 120. The purpose of pathway 128 is to provide a volume to collect fuel that may potentially leak from the high pressure pathway along the high pressure sleeve threads.

The fuel injectors according to the embodiments of the invention shown in FIGS. 3 and 4 comprise an axial based design for the various components of the injector. As a result of this axial arrangement the electrical 15 and backleak flow 17 components are independent of the high pressure fuel connection and as a result the inlet and outlet connections to the various fuel supply passages and electrical connections can be configured in any given orientation needed to fit the injector within a chosen engine environment. Such flexibility in the design advantageously improves the ability to fit the injector within a range of engine designs.

The flexible nature of the invention which is the subject of the present invention is illustrated with respect to the two cross section slices that have been taken through the fuel injectors of FIGS. 3 and 4. It is noted that the same cross section slices have been taken in each Figure and these have been marked up as section A-A and B-B.

Figure 5:
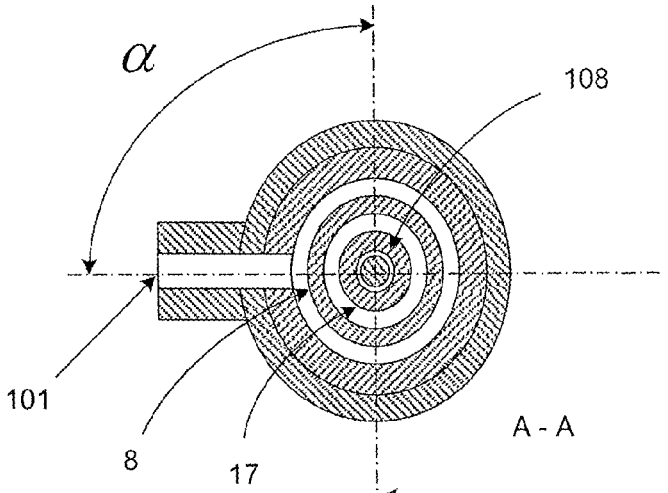
FIGS. 5 to 7 show cross sections through a fuel injector in accordance with embodiments of the present invention.

FIG. 5 shows section A-A looking along the fuel injector in the direction of the arrows A. It can be seen from FIGS. 3, 4 and 5 that section A-A is taken through the high pressure inlet 101, high pressure sleeve 102, backleak return pathway 17, low pressure sleeve 108 and electrical connections 15. From FIG. 5 it is clear that due to the annular configuration of the high pressure fuel pathway 8, the high pressure inlet 101 may take any orientation desired about the injector main axis 19.

Figure 6:
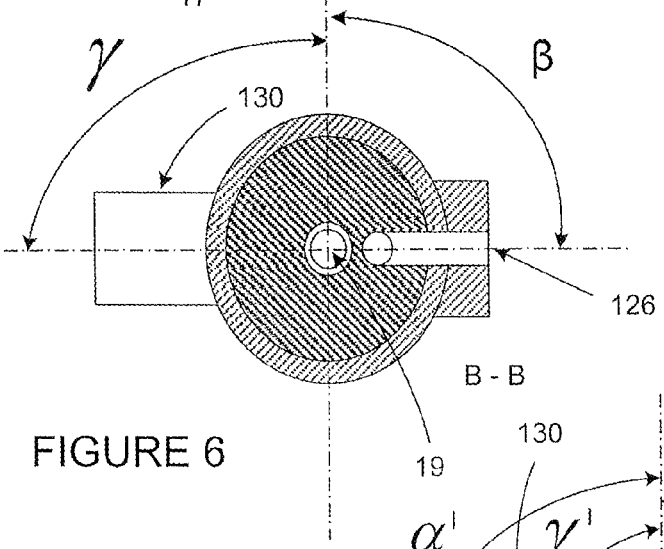

FIG. 6 shows section B-B looking along the fuel injector in the direction of the arrows B. It can be seen from FIGS. 3, 4 and 5 that section B-B is taken through the backleak return outlet 126. Although axially spaced from the backleak return outlet, FIG. 6 additionally shows the orientation of the electrical connection inlet/outlet 130 (electrical connection point 130) about the injector main axis 19. It can be seen from FIG. 6 that due to the annular configuration of these components and the fact that they are spaced apart along the main axis, they may be orientated to any required position about the main axis (indicated by angles $\gamma$ and $\beta$ in FIG. 6).

Figure 7:
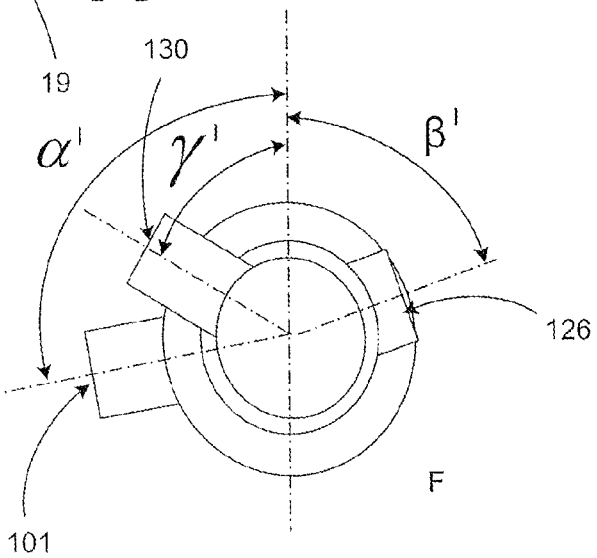

FIG. 7 shows a view of the fuel injector down the main injector axis from the top towards the injection nozzle. The various inlets and outlets (the "element connector means"), namely the high pressure fuel inlet 101, the backleak return outlet 126 and the electrical connections inlet/outlet 130, are visible and the various angles between each of these components are also depicted. As is clear from FIG. 7 these components are orientated in a different arrangement to those of FIGS. 5 and 6 thereby highlighting the flexibility of the present invention.

Figure 8:
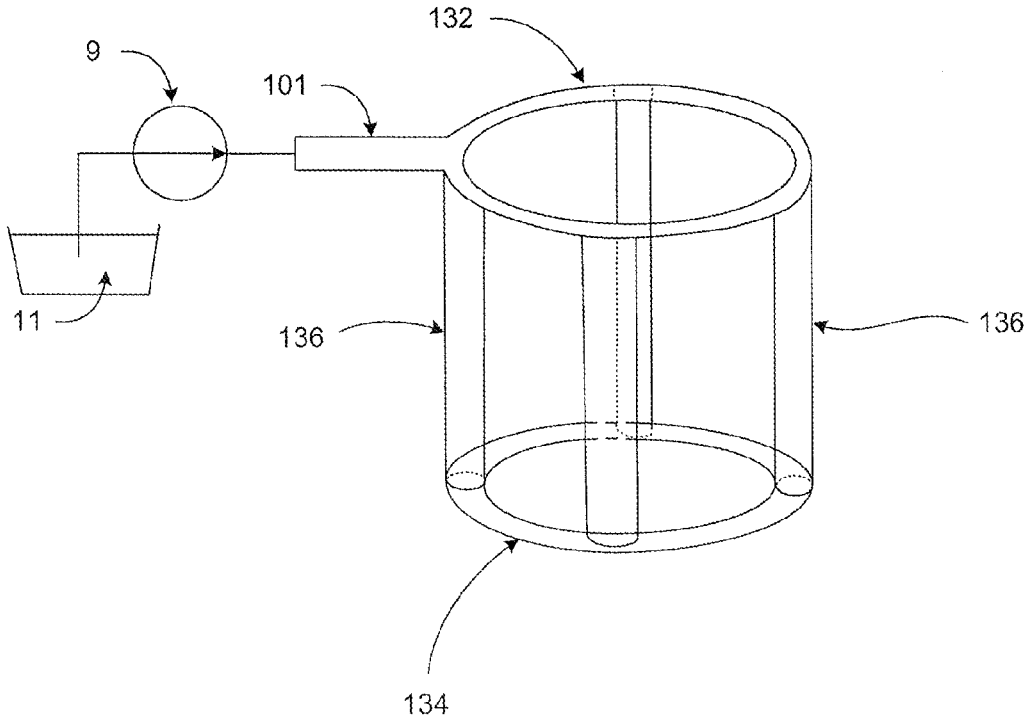
FIG. 8 shows an alternative arrangement for a fuel supply passage that may be used in accordance with embodiments of the present invention

Although FIGS. 3 to 7 show an annular configuration for the high pressure fuel pathway 8 and the backleak return path 17 it is to be appreciated that other arrangements may be possible. An alternative arrangement for the high pressure fuel pathway is shown in FIG. 8 comprising two circular (annular) pathways 132, 134 which are interconnected by a plurality of connecting passage ways 136. In a further alternative arrangement (not shown in the Figure) a single circular pathway (such as 132) only may be provided which is connected to one or more connecting passage ways (such as 136) which are in turn in fluid communication with the injector nozzle.

Similar alternative arrangements (whereby an element is in communication with an element connector means via an annular feature such as an annular passage or annular gallery) may be used for any of the elements within the fuel injector. For example, the backleak return fuel return 17 may comprise a straight drilling through the injector body which is in turn connected to an annular passage or gallery in the vicinity of a low pressure outlet such that the outlet is in fluid communication with the backleak return via the annular passage or gallery.

Figure 9:
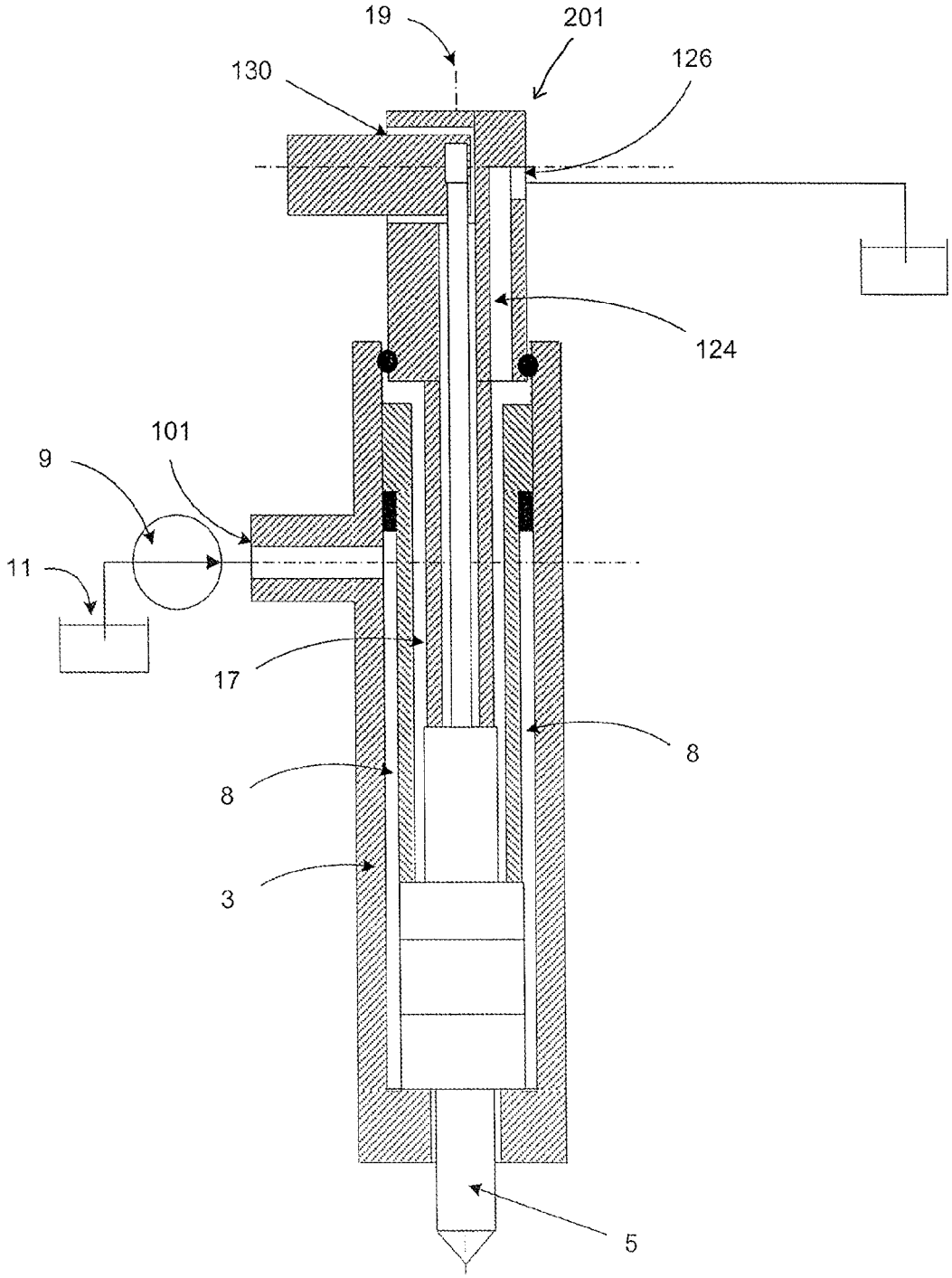
FIG. 9 shows a fuel injector in accordance with a yet further embodiment of the present invention.

FIG. 9 shows a yet further embodiment of the present invention. It is noted that this embodiment is similar to that of FIG. 3 and the differences between FIGS. 3 and 9 are discussed below.

In FIG. 3 it can be seen that the high pressure inlet 101 is a separate component 150 from the nozzle body holder 3. Sealing ring 152 is provided to seal the contact surface between the component 150 and the injector body 3.

In FIG. 9, in contrast to FIG. 3, the high pressure inlet 101 is integrally formed with the injector body 3.

It is noted that, compared to the arrangement of FIG. 9, the arrangement of FIG. 3 (a so-called "banjo connector" arrangement) simplifies the process of forming the injector body 3 (which can be a cylinder without any complex features).

It is further noted that, compared to the arrangement of FIG. 3, the arrangement of FIG. 9 simplifies the sealing function at the high pressure inlet 101.

Figure 10:
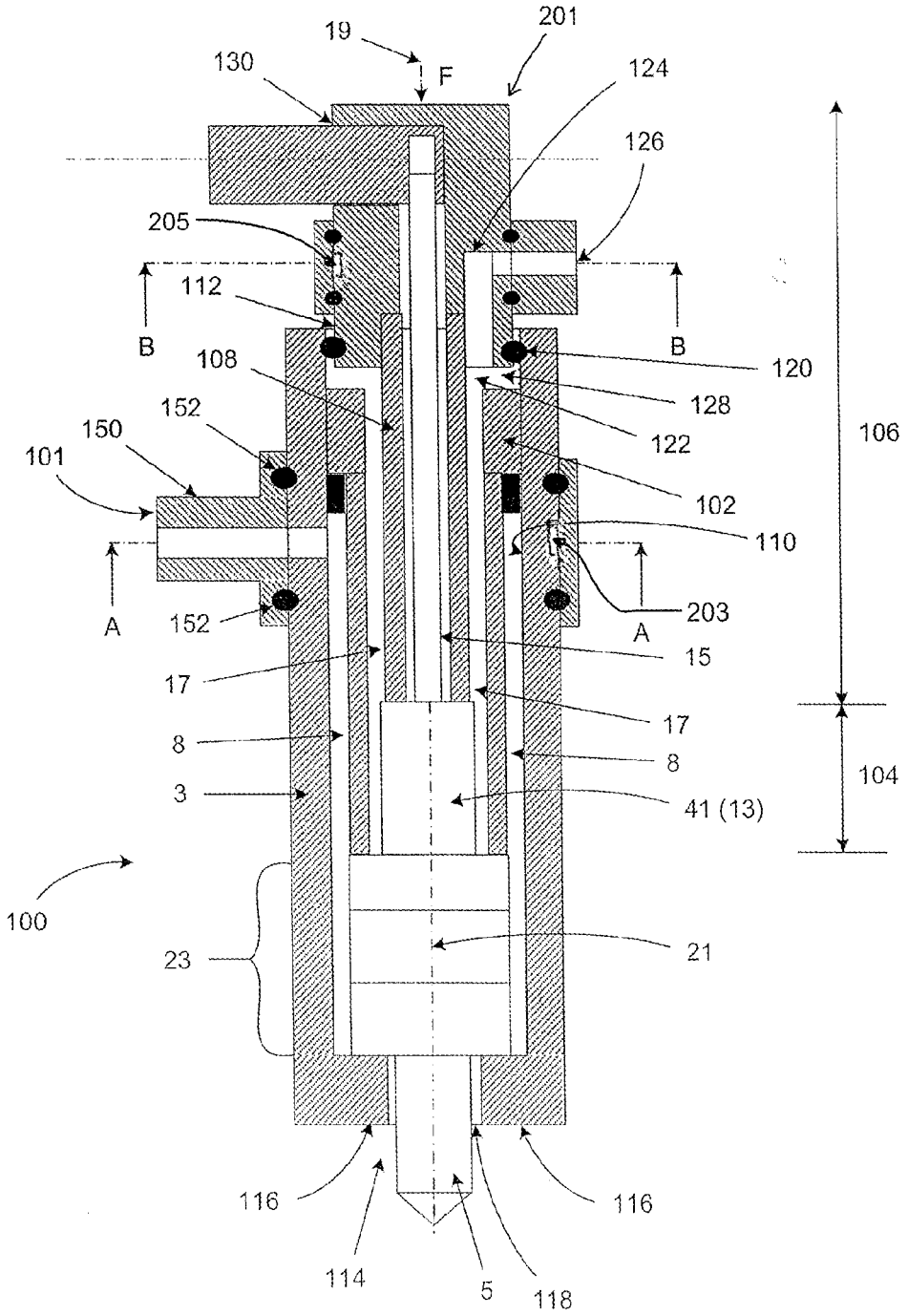
FIG. 10 shows a variation of the fuel injector of FIG. 3.

A still further embodiment of a fuel injector in accordance with an embodiment of the present invention is shown in FIG. 10. The injector shown is similar to that of FIG. 3 and the differences between FIGS. 3 and 10 are discussed below.

In the injector of FIG. 10 two annular galleries (203, 205) are provided. Annular gallery 203 is formed on the injector body 3. Annular gallery 205 is formed in the end cap arrangement 201. It is further noted that annular gallery 203 may be seen in the cross section shown in FIG. 11. Annular gallery 205 may be seen in the cross section through the injector shown in FIG. 12.

Whether the fuel injector comprises an annular gallery or not may determine the manner in which the element connector means may be rotated relative to one another.

For example in the arrangement shown in FIGS. 3, 4, 5 and 6 if it is desired to alter the relative angular position of the backleak return outlet 126 to the high pressure inlet 101 (in other words if it is desired to alter the angle $\gamma$ plus $\beta$), then the end cap arrangement 201 may be rotated relative to the injector body 3.

Figure 11:
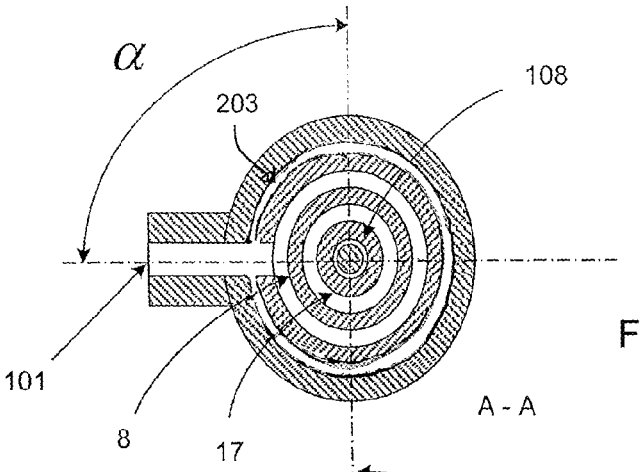
FIGS. 11 and 12 show a variation of the cross sections of FIGS. 5 and 6.
Figure 12:
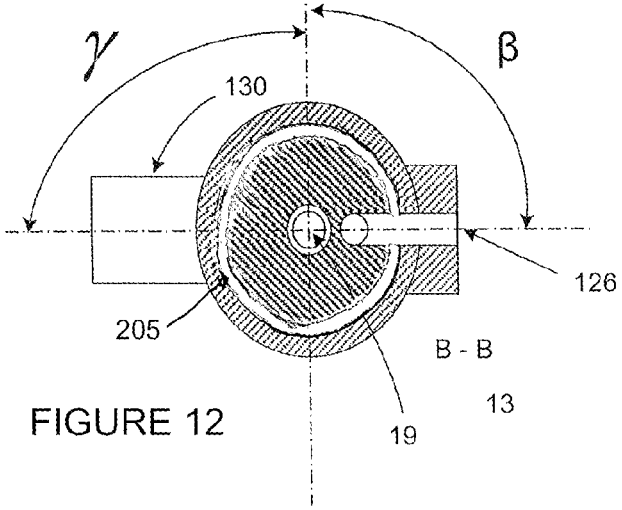

However, by contrast, in the arrangement shown in FIGS. 10, 11 and 12 the presence of the annular gallery 205 means that the backleak return outlet 126 may be rotated relative to the end cap arrangement 201 into any desired configuration (and still be in fluid communication with the backleak return fuel path 17). This also means that the relative angular position of the outlet 126 and the electrical connection point 130 may be rotated into any desired configuration in FIG. 10.

The presence of the annular gallery 203 also means that the high pressure inlet 101 may be rotated about the injector body axis relative to the injector body 3 (and still be in fluid communication with the high pressure fuel passage 3).

In a further variation of the above embodiments the electrical connection point 130 may be received within an arcuate slot in the end cap arrangement 201. In this manner the electrical connection point may be allowed limited annular movement about the injector body axis 19. In a yet further variation the low pressure sleeve 108 may be integrally formed with the end cap arrangement 201. In this yet further variation if the end cap arrangement 201 is rotated in order to vary the angular position of the element connector means then the low pressure sleeve will also rotate within the injector body 3.

The electrical connection point may also be arranged to be freely rotatable relative to the end cap arrangement 201. In such a variation the electrical connection point 130 may form the upper surface of the fuel injector. It is noted that the electrical connections 15 pass through a bore defined by the inner surface of the low pressure sleeve 108 into a similarly dimensioned bore within the end cap arrangement 201. In order to adequately seal this space from the engine system the radial extent of the electrical connection point 130 shown in FIG. 3, for example, may be increased such that the lower surface of the connection point 130 completely covers the bore below.

It will be understood that the embodiments described above are given by way of example only and are not intended to limit the invention, the scope of which is defined in the appended claims. It will also be understood that the embodiments described may be used individually or in combination.

The invention claimed is:

1. A fuel injector for an internal combustion engine, the fuel injector comprising:

an injector body of substantially elongate form extending along an injector body axis;

an injector nozzle disposed at one end of the injector body; and a plurality of element connectors for providing fluid and/or electrical connection into and/or out of the fuel injector wherein at least some of the element connectors are arranged to be rotatable relative to one another about the injector body axis independently of each other about the injector body axis.

2. A fuel injector as claimed in claim 1, wherein the plurality of element connectors comprises a high pressure fuel inlet and a low pressure fuel outlet, the inlet and outlet being rotatable relative to one another.

3. A fuel injector as claimed in claim 1, wherein the plurality of element connectors comprises at least one fuel related element connector that is rotatable about the injector body axis.

4. An injector as claimed in claim 1, wherein each of the element connectors are rotatable about the injector body axis.

5. A fuel injector as claimed in claim 1, further comprising a plurality of elements located at least in part within the injector body, each of the plurality of elements being in communication with an element connector.

6. A fuel injector as claimed in claim 5, wherein the elements within the injector body are arranged axially about the injector body axis.

7. A fuel injector as claimed in claim 5, wherein one of the plurality of the elements is a fuel supply passage.

8. A fuel injector as claimed in claim 7, wherein the fuel supply passage is arranged annularly about the injector body axis.

9. A fuel injector as claimed in claim 5, further comprising a needle member which is engageable with a needle seating to control fuel delivery from the injector nozzle and an actuator arrangement to control movement of the needle member, wherein the actuator arrangement and injector body define a common axis.

10. A fuel injector as claimed in claim 9, wherein the fuel supply passage surrounds the actuator arrangement.

11. A fuel injector as claimed in claim 5, wherein the plurality of elements further comprises a backleak return fuel path arranged in use to return fuel to a fuel reservoir; an electrically controlled actuator arrangement for controlling fuel supply through the injector nozzle; and electrical connections arranged to connect the actuator arrangement to a control unit.

12. A fuel injector as claimed in claim 11, wherein the fuel supply passage arrangement surrounds the backleak return path, actuator arrangement and electrical connections, and wherein the plurality of elements are concentrically mounted.

13. A fuel injector as claimed in claim 11, wherein the connector of the fuel supply passage is a high pressure fuel inlet, the connector of the backleak return is a low pressure fuel outlet, and the connector of the electrical connections is an electrical connection point, wherein the high pressure inlet is integrally formed with injector body.

14. A fuel injector as claimed claim 5, wherein the injector body defines a bore, the bore having an open first end and a partially closed second end, the second end comprising an opening through which the injector nozzle projects, and one of the plurality of elements is a fuel supply passage and a first surface of the fuel supply passage is defined by the injector body and a second surface of the fuel supply passage is defined by a high pressure sleeve, the sleeve being arranged such that, in use, sleeve generated loadings seal the fuel supply passage at the partially closed end.

15. A fuel injector as claimed in claim 14, wherein at least one of the plurality of elements abuts and is held in place by the partially closed end of injector body.

16. A fuel injector as claimed in claim 15, wherein the plurality of elements are arranged to be urged towards the partially closed end by sleeve generated loadings.

17. A fuel injector as claimed in claim 5, wherein a first end of the injector body has an opening through which the injector nozzle projects and wherein the injector body defines a bore within which a high pressure sleeve is located, an annular gap between the sleeve and injector body defining a fuel supply passage.

18. A method of assembling a fuel injector comprising providing an injector body of substantially elongate form extending along an injector body axis, the injector body defining a bore, the injector body having an open end and a partially closed end, the partially closed end comprising an opening dimensioned to receive an injector nozzle, the method comprising inserting an injector nozzle into the open end of the bore and through the opening in the partially closed end of the injector body so that the nozzle is disposed at one end of the injector body;

inserting a plurality of elements of the fuel injector into the bore via the open end;

providing a plurality of element connectors for providing fluid and/or electrical connection into and/or out of the fuel injector, wherein at least some of the element connectors are arranged to be rotatable relative to one another about the injector body axis independently of each other about the injector body axis; and fixing an end cap arrangement to the open end of the injector body.

19. A method as claimed in claim 18, wherein the injector body defines an injector body axis and the elements are annularly arranged about the injector body axis.

20. A method as claimed in claim 18, further comprising rotating at least one element connector relative to the injector body axis until a desired orientation of the element connectors is achieved.

* * * * *